United States Patent [19]

Desmond

[11] Patent Number: 4,506,585

[45] Date of Patent: Mar. 26, 1985

[54] STRINGED INSTRUMENT

[76] Inventor: Jean-Luc Desmond, 2, Impasse Margueriteau, 94150 Chevilly Larue, France

[21] Appl. No.: 477,988

[22] Filed: Mar. 23, 1983

[51] Int. Cl.[3] ..... G10D 3/04

[52] U.S. Cl. ..... 84/298; 84/297 R

[58] Field of Search ..... 84/267, 297 R, 298, 84/299, 307, 312 R, 313

[56] References Cited

U.S. PATENT DOCUMENTS

| | | | |
|---|---|---|---|
| 2,416,593 | 2/1947 | Proll | 84/297 R |
| 3,599,524 | 8/1971 | Jones | 84/298 |
| 4,341,144 | 7/1982 | Milne | 84/307 |
| 4,453,443 | 6/1984 | Smith | 84/298 |

*Primary Examiner*—Lawrence R. Franklin

*Attorney, Agent, or Firm*—Brisebois & Kruger

[57] ABSTRACT

A stringed musical instrument comprises a body (1) over which are stretched substantially parallel strings (4). Each string is stretched between a tuning key (3) and a bridge-tailpiece assembly (7). This assembly comprises a plate (8) attached to the body (1) and a respective adjustment member for each string mounted on the plate (8). Each adjustment member comprises a peg (15) movable in translation relative to the plate (8) parallel to the corresponding string and a bridge member (18) pivoted to the peg. The bridge member (18) may be oriented relative to the plate (8) of the bridge-tailpiece assembly (7) by a positioning device (22). The bridge-tailpiece assembly (7) comprises a bore (20) through which the corresponding string (4) passes, this string being hooked on to the body (1) at a point such that it bears on the bridge member (18) over substantially the entire length of the bore (20) and that the positioning device is pushed on the body by the string tension.

17 Claims, 4 Drawing Figures

FIG. 3
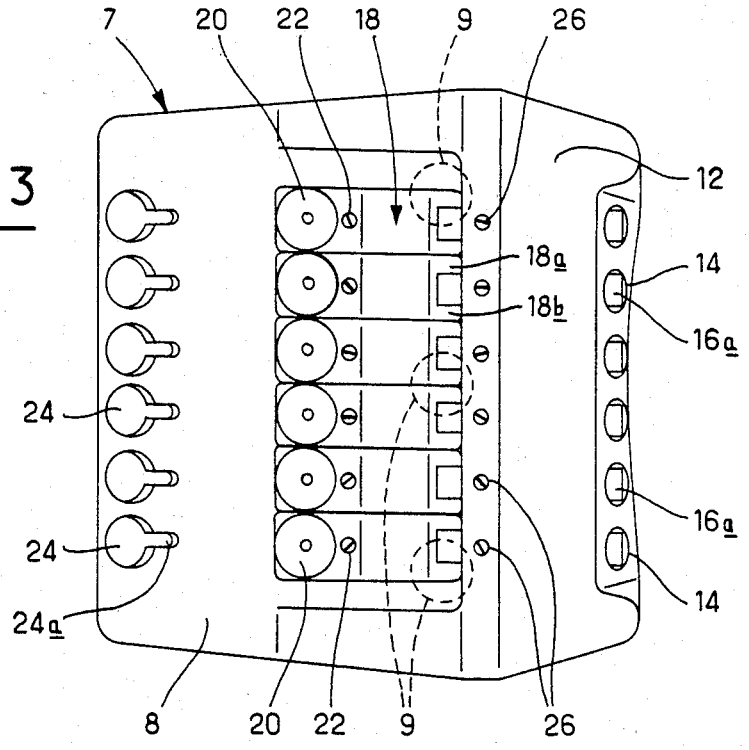
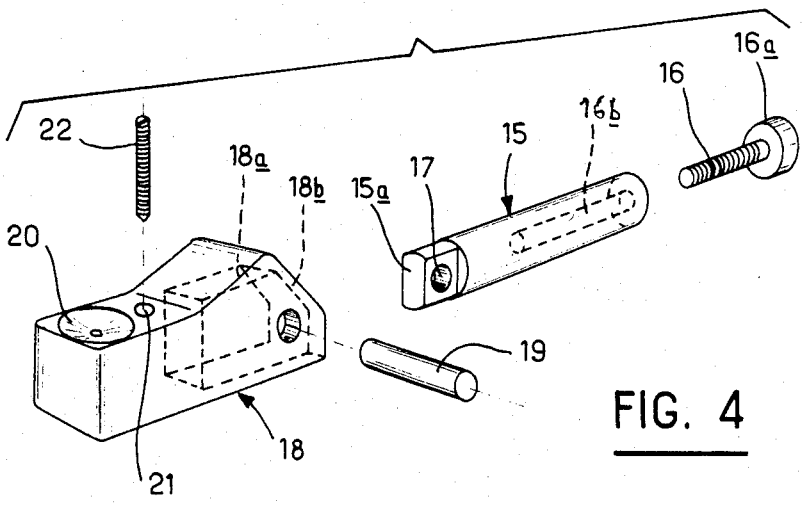
FIG. 4

STRINGED INSTRUMENT

BACKGROUND OF THE INVENTION

1. Field of the Invention

The present invention relates to a musical instrument having strings which are plucked, bowed or struck, comprising a device for adjusting and hooking on the strings. A device of this kind is generally called a "bridge-tailpiece assembly". The invention is more particularly concerned with a bridge-tailpiece assembly intended for electric guitars and, in particular, for instruments with six or four strings.

2. Description of the Prior Art

In the known manner, a bridge-tailpiece assembly has more than one function: on the one hand, it is used to hook on the strings and to adjust their position relative to the body of the instrument; on the other hand, it serves to transmit energy generated by the vibration of the string to the body of the instrument. In currently known bridge-tailpiece assemblies, transmission of energy from the string to the body of the instrument is relatively inefficient; damping of the vibration occurs, altering the output of the instrument from the point of view of the length of the note and also its purity. For example, U.S. Pat. No. 4,031,799 describes a bridge-tailpiece assembly in which each string passes over a drum whose height relative to the plate of the bridge-tailpiece assembly is adjusted by means of screws, the drum being maintained in position relative to the plate by means of a spring; the string is hooked onto the body and rests in a channel formed in the outside surface of the corresponding drum. In this embodiment, the screws for adjusting the position of the drums are used to adjust the distance between the string and the body to the required value, but the string is in only very limited contact with the drum which supports it, resulting in poor musical output.

An objective of the invention is to propose a bridge-tailpiece assembly eliminating the vibration damping phenomenon and therefore improving the transmission of vibrational energy from the string to the body of the instrument.

SUMMARY OF THE INVENTION

Consequently, the object of the invention consists in the new industrial product constituted by a stringed musical instrument comprising a body over which are stretched substantially parallel strings, each string being stretched between a tuning key disposed at one end of the instrument and an area substantially in line with a bridge-tailpiece assembly mounted on the body of the instrument, the bridge-tailpiece assembly comprising a plate attached to said body and, for each string, a respective adjustment member mounted on said plate, characterized in that each adjustment member comprises a first element movable in translation relative to the plate in a direction substantially parallel to the direction of the corresponding string and a second element, attached to but pivotable relative to the first element, which may be oriented relative to the plate of the bridge-tailpiece assembly by virtue of a positioning device and which comprises a bore through which the corresponding string passes, said string being hooked on to the body at a point such that the string bears on the second element over substantially the entire length of the aforementioned bore and that the positioning device is pushed by the tension of the string on the body or a piece integral with the body. Advantageously, the positioning device may be pushed on the plate of the bridge-tailpiece assembly by the tension of the string.

It results from the structure described above that the second element of each adjustment member is in static equilibrium; this avoids any influence of the construction clearances and improves the clearness and the length of the sound produced by the string.

In a first embodiment, the string is hooked on at a point on the plate of the bridge-tailpiece assembly which, relative to the bore in the second element, is disposed in the direction towards the corresponding tuning key; in this case, the plate may comprise, for each string, a respective opening through which the string may be passed, said string incorporating a ball-end which is retained beneath the opening in the plate through which the string passes; the body comprises a hollow in line with the openings in the plate which enables the ball-ends for hooking on all the strings to be fitted.

In a second embodiment, the string passes through the plate and the body of the instrument substantially in line with the bore formed in the second element, said string being hooked on through the maintaining of the ball-end of the string in the vicinity of the side of the body on which the bridge-tailpiece assembly is not mounted.

In a preferred embodiment, the second element of the hooking on member comprises a thick metal bridge member coupled to the first element by a pin substantially parallel to the plate of the bridge-tailpiece assembly and substantially perpendicular to the string; the axis of the bore in the bridge member is at an angle of between 80° and 90° to the plate of the bridge-tailpiece assembly; the end of the bore in the bridge member which does not face towards the plate is flared to a rounded funnel shape; advantageously, the bore in the bridge member has both ends flared to a rounded funnel shape; the positioning device associated with the second element is a screw which cooperates with a female thread formed in the bridge member and whose lower end bears on the plate of the bridge-tailpiece assembly; the screw which serves as the device for positioning the bridge member is disposed between the bore through which the string passes and the articulation of the bridge member to the first element.

The plate of the bridge-tailpiece assembly advantageously comprises on the side which faces towards the body a plurality of bushes which pass through the body, the bridge-tailpiece assembly being attached to the body by immobilizing the body between the plate of the bridge-tailpiece assembly and a clamping plate attached to the ends of said bushes; the plate of the bridge-tailpiece assembly comprises, in that part farthest removed from the keys for tuning the strings, a thick section constituting a base through which pass the first elements of the adjustment members associated with the respective strings; the bushes of the bridge-tailpiece assembly are substantially aligned with the area in which the first and second elements of the adjustment members are pivoted together; the first element of an adjustment member may comprise a peg which slides freely in the base and which comprises a substantially axial threaded bore which cooperates with a screw whose head bears on the part of the base which does not face the tuning keys, said peg being articulated to the second element of the adjustment member by that of its ends which does not cooperate with said screw, said end projecting relative to said base; the peg axis is substantially parallel to the direction of the string associated with it and parallel to the side of the body on which the plate of the bridge-tailpiece assembly is mounted; the peg may preferably be locked in position in the base by means of a grubscrew once the tension in the string has been adjusted.

For a better understanding of the object of the invention, an embodiment shown in the accompanying drawings will now be described, by way of non-limiting example only.

BRIEF DESCRIPTION OF THE DRAWINGS

In the drawings:

FIG. 3 represents the bridge-tailpiece assembly of the guitar of FIG. 1 seen in plan view with the strings not fitted;

FIG. 4 is an exploded view in perspective showing the assembly of the first and second elements of an adjustment member of the bridge-tailpiece assembly of the instrument of FIG. 1.

DESCRIPTION OF THE PREFERRED EMBODIMENT

Figure 1:
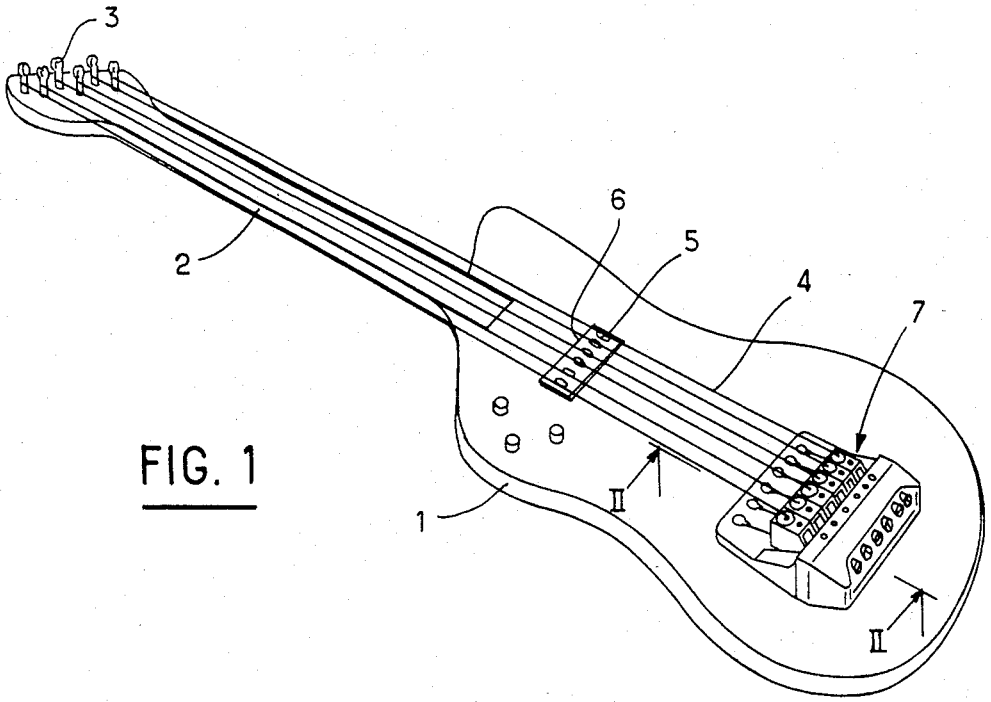
FIG. 1 represents a six-string electric guitar in accordance with the invention in perspective.
Figure 2:
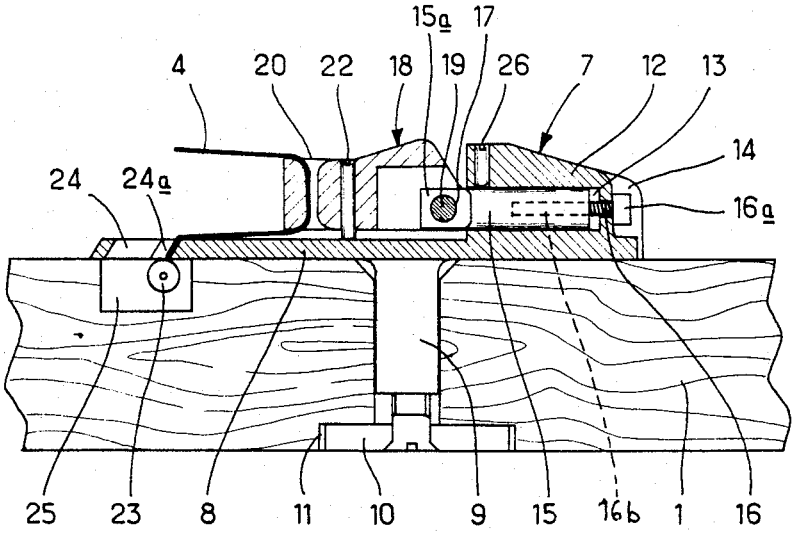
FIG. 2 represents a partial cross-section on the line II—II in FIG. 1, at the level of the bridge-tailpiece assembly.

Referring to the drawings, it is seen that the body of the electric guitar in accordance with the invention has been designated 1. Body 1 is connected to one end of a neck 2 whose other end carries six tuning keys 3. The instrument is equipped with six strings 4 disposed substantially parallel to one another above body 1 and neck 2 of the instrument. Each of strings 4 passes above a pick-up 5, the set of pick-ups being disposed on a plate 6 mounted on body 1 in the vicinity of the area of its connection to neck 2; pick-ups 5 are connected to the electronic circuitry of the apparatus. Each of strings 4 is stretched between a tuning key 3 and a bridge-tailpiece assembly generally designated 7.

Bridge-tailpiece assembly 7 consists of a plate 8 which is mounted on body 1. The side of plate 8 which is in contact with body 1 carries three bushes 9 perpendicular to plate 8, the axes of the three bushes being coplanar. The three bushes 9 pass through body 1 of the instrument and cooperate, by their end not connected to plate 8, with a clamping plate 10 which is accommodated in a recess 11 formed in that side of the body which does not support plate 8. The clamping plate thus provides for attaching plate 8 to body 1 by means of screws which engage in threaded bores in bushes 9, body 1 being clamped between clamping plate 10 and plate 8 of the bridge-tailpiece assembly.

On its side opposite that on which bushes 9 are disposed plate 8 has, at the end farthest removed from tuning keys 3, a base 12 projecting above body 1. Base 12 is pierced by six parallel bores 13. The axes of bores 13 are disposed substantially parallel to respective strings 4 of the instrument; they are substantially parallel to body 1 and perpendicular to the plane of the axes of bushes 9. Each bore 13 has a large-diameter section facing towards tuning key 3 and a small-diameter section which opens on to the side of the base farthest removed from tuning keys 3. The small-diameter sections of bores 13 open into an opening 14 in base 12. The large-diameter sections of bores 13 each contain a peg 15 which can slide freely within bore 13. A screw 16 passes longitudinally through the small-diameter section of each bore 13 and cooperates with a threaded bore **16*b* along the axis of peg 15 and in that part of the peg farthest removed from tuning keys 3. The heads 16*a* of screws 16 bear against the side of the base which constitutes the bottom of opening 14. Pegs 15 are cylindrical but comprise, on the side of keys 3, a flattened section 15*a* in which is formed an orifice 17 whose axis is perpendicular to that of peg 15**.

Bridge-tailpiece assembly 7 comprises, for each string 4 of the instrument, an adjustment member whose first element consists of one of pegs 15 and whose second element consists of a bridge member 18 articulated to the corresponding peg 15 by means of a pin 19 passing through flattened section **15*a* by virtue of orifice 17. In the area in which it is linked to peg 15, bridge member 18 comprises two flanges 18*a*, *18b* together constituting a stirrup member inside which is accommodated flattened section 15*a* of peg 15. Flanges 18*a*, 18*b* comprise bores with aligned axes which receive the ends of pin 19 so as to articulate bridge member 18 to peg 15**.

That part of bridge member 18 closest to tuning keys 3 comprises a bore 20 which extends completely through it and the axis of which is perpendicular to the common axis of the bores in flanges **18*a*, 18*b* for pivot pin 19. Both ends of bore 20 have a rounded funnel-shaped profile and the bore merges with the edge surfaces of the bridge member without any sharp angles. Between the stirrup member delimited by flanges 18*a*, 18*b* on the one hand and bore 20 on the other hand is a threaded bore 21 in bridge member 18, the axis of which is parallel to that of bore 20, bore 21 accommodating a positioning screw 22 one end of which projects from the side of the bridge member which faces plate 8, the other end comprising a diametral groove to permit the use of a screwdriver. It will be thus be noted that the position of bridge member 18 relative to the plate is adjusted by turning screw 22, bridge member 18 being able to pivot around pin 19**.

The string 4 associated with an adjustment member of the bridge-tailpiece assembly is attached at one end to a tuning key 3 and is passed over bridge member 18 and through bore 20, then extending again in the direction towards the tuning key. String 4 is hooked on by means of a ball-end 23 attached to the end of the string not attached to key 3. This ball-end 23 can be passed through plate 8 by means of an opening 24 which is of circular shape extended by a slot **24*a* whose axis is substantially parallel to the direction of string 4. Ball-end 23 is disposed beneath plate 8 and string 4 engaged in slot 24*a* so that ball-end 23 is brought into abutment against plate 8 in line with slot 24*a* when string 4** is tensioned.

In this way, this arrangement enables string 4 to be hooked on to plate 8. String 4 bears on the lateral wall of bore 20 over substantially all the length of the latter, which ensures perfect transmission of vibration from string 4 to bridge member 18 and, consequently, to the bridge-tailpiece assembly and body 1. A recess 25 is naturally provided beneath plate 8 and in line with openings **24, 24*a* to permit ball-ends 23 to be fitted, this recess being hollowed out from the thickness of body 1**.

When string 4 is stretched, bridge member 18 exerts traction in the direction of key 3 on peg 15 and head **16*a* of screw 16 is consequently held tightly against base 12 of the bridge-tailpiece assembly. The vibrational energy is transmitted from the string to the bridge member by virtue of the excellent contact along a generatrix of bore 20, and then from bridge member 18 to pin 19, from pin 19 to peg 15, from peg 15 to base 12 through head 16***a*, from base 12 to plate 8 and from plate 8 to body 1. This perfect transmission of the vibrational energy results in a remarkable degree of musicality for an instrument in accordance with the invention. Note that it is possible to adjust the height of string 4 relative to body 1, that is to say relative to pick-up 5, by turning screw 22 which pivots the bridge member. This pivoting is generally of limited amplitude and the angle between the axis of bore 20 and plate 8 is between 80° and 90°. Also, peg 15 may be moved in translation within bore 13 by turning screw 16, which provides for adjusting the pitch, that is to say the accuracy of the sound obtained. When the pitch has been adjusted, peg 15 is locked in position in its bore 13 by means of a grubscrew 26 disposed in a threaded bore in base 12 in line with peg 15 perpendicular to plate 8. Base 12 comprises as many grubscrews 26 as there are pegs 15 to be locked in position.

It will be understood that the embodiment described hereinabove has no limiting effect and may be modified in any desirable manner without thereby departing from the scope of the invention.

It is claimed:

1. A stringed musical instrument comprising a body over which are stretched substantially parallel strings, each string being stretched between a tuning key disposed at one end of the instrument and an area substantially in line with a bridge-tailpiece assembly mounted on the body of the instrument, the bridge-tailpiece assembly comprising a plate attached to said body and, for each string, a respective adjustment member mounted on said plate, characterized in that each adjustment member comprises a first element movable in translation relative to the plate in a direction substantially parallel to the direction of the corresponding string and a second element, attached to but pivotable relative to the first element, which may be oriented relative to the plate of the bridge-tailpiece assembly by virtue of a positioning device and which comprises a bore through which the corresponding string passes, said string being hooked onto the body at a point such that the string bears on the second element over substantially the entire length of the aforementioned bore and that the positioning device is pushed by the tension of the string on the body or a piece integral with the body.

2. An instrument according to claim 1, characterized in that the positioning device is pushed on the plate of the bridge-tailpiece assembly by the tension of the string.

3. An instrument according to claim 1, characterized in that the string is hooked on at a point on the plate of the bridge-tailpiece assembly which, relative to the bore in the second element, is disposed in the direction towards the corresponding tuning key.

4. An instrument according to claim 3, characterized in that the plate comprises, for each string, a respective opening through which the string may be passed, said string incorporating a ball-end which is retained beneath the opening in the plate through which the string passes.

5. An instrument according to claim 4, characterized in that the body comprises a recess in line with the openings in the plate to enable the ball-ends for hooking on all the strings to be fitted.

6. An instrument according to claim 1, characterized in that the second element of the adjustment member comprises a thick metal bridge member coupled to the first element by a pin substantially parallel to the plate of the bridge-tailpiece assembly and substantially perpendicular to the string.

7. An instrument according to claim 1, characterized in that the axis of the bore in the second element is at an angle of between 80° and 90° to the plate of the bridge-tailpiece assembly.

8. An instrument according to claim 1, characterized in that the end of the bore in the second element which does not face towards the plate is flared to a rounded funnel shape.

9. An instrument according to claim 8, characterized in that the bore in the second element has both ends flared to a rounded funnel shape.

10. An instrument according to claim 1, characterized in that the positioning device associated with the second element is a screw which cooperates with a female thread formed in the second element and whose lower end bears on the plate of the bridge-tailpiece assembly.

11. An instrument according to claim 10, characterized in that the screw which serves as the device for positioning the second element is disposed between the bore through which the string passes and the articulation of the second element to the first element.

12. An instrument according to claim 1, characterized in that the bridge-tailpiece assembly comprises on the side which faces towards the body a plurality of bushes which pass through the body, the bridge-tailpiece assembly being attached to the body by immobilizing the body between the plate of the bridge-tailpiece assembly and a clamping plate attached to the ends of said bushes.

13. An instrument according to claim 12, characterized in that the bushes of the bridge-tailpiece assembly are substantially aligned with the area in which the first and second elements of the adjustment members are pivoted together.

14. An instrument according to claim 1, characterized in that the plate of the bridge-tailpiece assembly comprises, in that part farthest removed from the tuning keys, a thick section constituting a base through which pass the first elements of the adjustment members associated with respective strings.

15. An instrument according to claim 14, characterized in that the first element of an adjustment member comprises a peg which slides freely in the base and which incorporates a substantially axial threaded bore which cooperates with a screw whose head bears on the part of the base which does not face the tuning keys, said peg being articulated to the second element of the adjustment member by that of its ends which does not cooperate with said screw, said end projecting relative to said base.

16. An instrument according to claim 15, characterized in that the peg axis is substantially parallel to the direction of the string associated with it and parallel to the side of the body on which the plate of the bridge-tailpiece assembly is mounted.

17. An instrument according to claim 15, characterized in that the peg may be locked in position in the base by means of a grubscrew threaded into the base.

* * * * *